United States Patent [19]

Kirk

[11] 4,228,559

[45] Oct. 21, 1980

[54] BRUSH DEVICE

[76] Inventor: Norbert A. Kirk, 43 E. Ohio St., Room 930, Chicago, Ill. 60611

[21] Appl. No.: 940,303

[22] Filed: Sep. 6, 1978

[51] Int. Cl.[3] ..... A46B 13/06; A47L 15/00

[52] U.S. Cl. ..... 15/75; 15/69; 415/80

[58] Field of Search ..... 15/56, 69, 70, 74, 75, 15/101; 415/80, 85, 82; 416/20 R, 20 A

[56] References Cited

U.S. PATENT DOCUMENTS

| | | | |
|---|---|---|---|
| 1,831,684 | 11/1931 | Peterson | 15/69 X |
| 1,876,895 | 9/1932 | Fleminng | 15/69 |
| 2,215,400 | 9/1940 | Malpass | 15/75 |
| 2,563,528 | 8/1951 | Hamilton | 15/75 |
| 3,121,897 | 2/1964 | Lambrich | 15/69 X |

*Primary Examiner*—Edward L. Roberts

*Attorney, Agent, or Firm*—Larson, Taylor and Hinds

[57] ABSTRACT

A device for washing dishes and drinking utensils is provided using a faucet attached, water-powered rotating brush. Water jet action provides the motive force and the water can also be used to aid in washing.

11 Claims, 3 Drawing Figures

BRUSH DEVICE

FIELD OF THE INVENTION

The present invention relates to a water powered device for washing and cleaning dishes and the like.

BACKGROUND OF THE INVENTION

Devices have been made which operate from water fluid pressure which perform a variety of household functions. Examples of these devices are described in U.S. Pat. Nos. 621,036; 661,512; 1,539,245; and 1,549,774. This type of device, which operates using a water wheel, generates low power torque and therefore functions poorly under more demanding conditions. As a result of their inefficient power utilization, excessive quantities of water are required for their use, causing increased water expenses and heightened wear resulting in frequent repairs and short-lived use. Furthermore, these devices often require gears and bulky paddle wheel designs which makes them cumbersome in size, inherently expensive, and subject to frequent breakage.

It is an object of the present invention to provide a water powered brush device which is simple in construction, robust, and which develops a good deal of power using a relatively small amount of water at normally available faucet pressure. These and other objects which will be apparent to those of ordinary skill in the art are achieved in accordance with the present invention as will be apparent from the description which follows.

SUMMARY OF THE INVENTION

In accordance with the invention, a compact, efficient, water powered device is provided for washing and cleaning dishes and mugs and the like. High power torque is generated through the use of jet action.

According to the present invention, a water powered brush device is provided which comprises a chamber, round in horizontal cross-section, and having a top wall, a bottom wall, and a peripheral side wall joining the top and bottom walls. A rotatable tubular member is mounted for rotation in the chamber. At least two tubular arms are mounted on the rotatable tubular member and extend outwardly therefrom for rotation with the rotatable member and in a horizontal plane in the chamber. Each arm includes at least one orifice for discharge of a high velocity stream of water in a direction to impart rotation of the arms and the rotatable member. The rotatable tubular member and the tubular arms together form a conduit for conveying water under pressure to the orifice for discharge therethrough. Means are provided for securing the device to a faucet and for conveying water under pressure from the faucet to the rotatable tubular member. Water discharging from the orifices into the chamber is removed by outlet means to permit rotation of the arms in the chamber unobstructed by discharged water accumulating in the chamber. A rotatable brush is mounted below the bottom wall of the chamber and means are positioned to cause the brush to rotate upon rotation of the tubular rotatable member. With the device secured to a faucet, faucet water is conveyed into the rotatable tubular member, through the outwardly extending arms, and discharges out of the orifices provided in the arms thereby causing rotation of the arms and rotatable member and the downwardly extending brush.

There follows a detailed description of preferred embodiments of the invention including drawings of which:

FIG. 1 is a diagrammatic cross-sectional elevation view of a device according to the invention;

FIG. 2 is a diagrammatic cross-sectional plan view of member 30 of FIG. 1 taken along a diameter of hollow arms 32, 33 of member 30 and showing an alternative type of arm closure member 38';

FIG. 3 is a diagrammatic cross-sectional view of member 30 of FIG. 1 taken along a diameter of arms 32, 33 and showing an alternative type of arm 32', 33' and an alternative type of arm closure member 38''.

DETAILED DESCRIPTION

Figure 1:
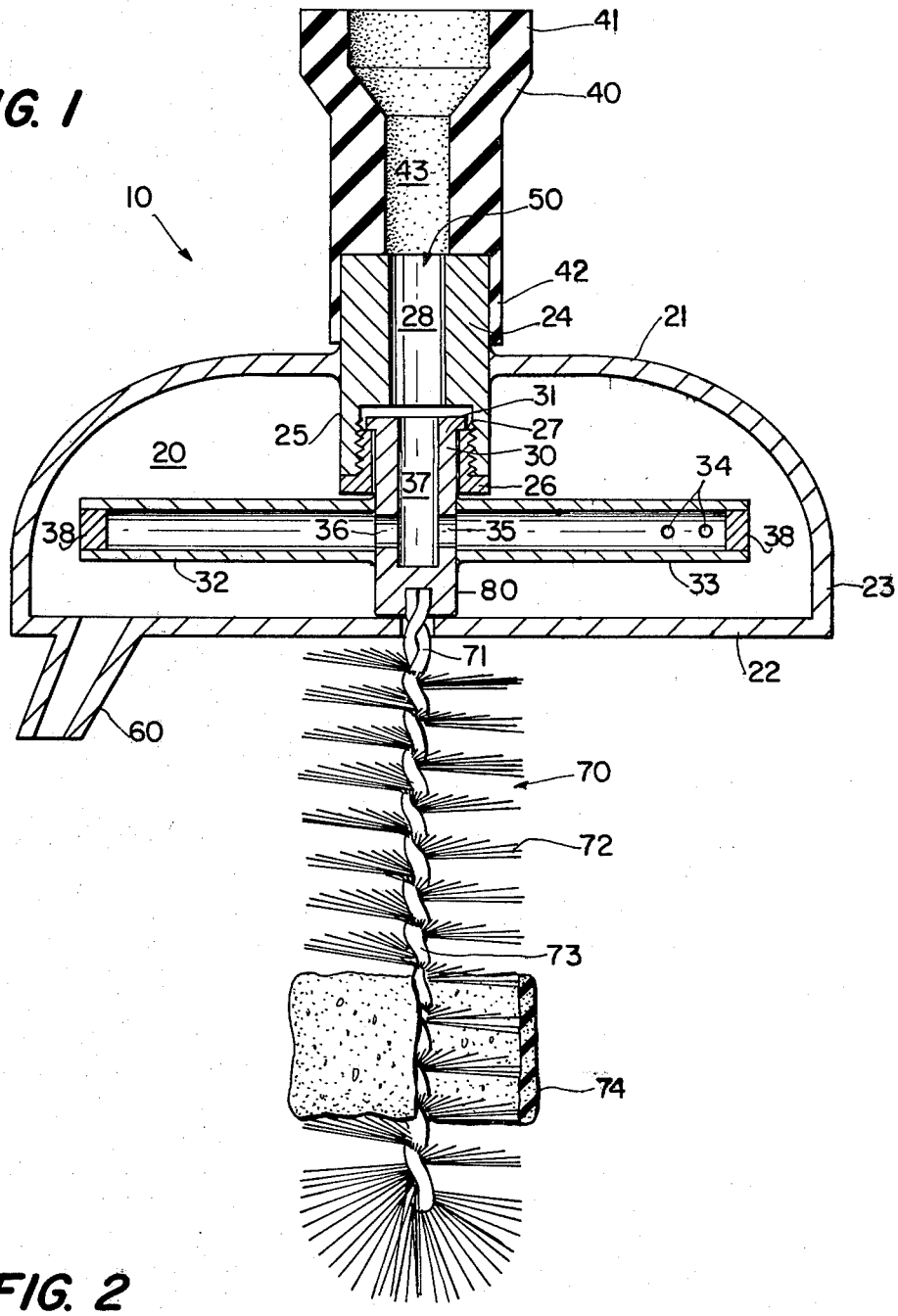

With reference to FIG. 1, a rotating brush device 10 according to the invention includes a chamber 20, a rotating tubular member 30, means 40 for securing the device to a water faucet, a conduit 50 for conveying water under pressure from a faucet to tubular rotatable member 30, water outlet means 60, a rotatable brush 70, and means 80 connecting rotatable member 30 and brush 70 for rotation therewith.

Chamber 20 is round in horizontal cross-section and includes a top wall 21, a bottom wall 22, and a peripheral side wall 23 joining the top and bottom walls. The chamber is conveniently made from transparent plastic and is fabricated in two or more pieces rather than in a single piece as shown for clarity of illustration. For example, bottom wall 22 may be formed as a separate disc piece which is glued or otherwise fixed to the lower edge of peripheral wall 23. Several parts are accommodated within chamber 20 and assembly of the device is thus facilitated by forming the chamber from two or more pieces. The walls are preferably imperforate except as shown but may include openings if desired, particularly in those portions not contacted by water which sprays in the chamber during use of the device as explained below. It will be understood that the top, bottom and side walls need not be sharply defined. For example, the chamber may be spherical in which case there is no sharp delineation between the wall portions. It will be understood, therefore, that the terms are used to define a chamber and to provide terms of reference for the arrangement of other parts of the device.

Tubular member 30 is mounted for rotation in chamber 20 by means of tubular bearing member 24 which is fixed to top wall 21 by adhesive or in any convenient manner. Member 24 may readily be formed in one piece with chamber 20 or with top wall 21 of chamber 20. The lower portion 25 includes a cavity into which the upper part of rotatable member 30, formed into an outwardly extending flange 31, fits. The inner wall of the cavity in member 24 is threaded to receive a threaded cap member 26 having an upper bearing surface 27 on which the lower bearing surface of flange 31 rests.

Rotatable member 30 is provided with two or more tubular arms 32, 33, two of which are shown in the embodiment of FIG. 1. Arms 32, 33 are fixed to rotatable member 30 such as by adhesive, by threading, or the like, or they may be formed therewith in a single piece. The various parts of the device, including members 24 and 30 and arms 32 and 33 may be fabricated of any suitable material but plastic is preferred since it is relatively inexpensive, easy to fabricate, and does not corrode. Arms 32, 33 extend generally radially outwardly and horizontally from member 30. In the illustrated embodiment, the arms extend along radii of a circle whose center is at the axis of rotation of member 30. However, the arms may extend forwardly or rearwardly at an angle with respect to a radius of that circle. Moreover, while the arms in the illustrated embodiment are straight, they may be curved, particularly in a horizontal plane.

Each of the arms 32, 33 includes one or more openings 34 or other orifice means for discharge of a high velocity stream of water out of its respective tubular arm in a direction to impart rotation of the arms and rotatable member 30 about the axis of rotation of member 30. The openings are constructed and arranged to direct the water stream generally horizontally tangentially in a direction opposite to the path of rotation of the opening through which the stream is directed. The orifices in arm 32 are thus provided in the wall which is out of the plane of the paper in which FIG. 1 is drawn and thus not shown. Rotation of arms 32, 33 in this embodiment is thus clockwise when viewed from the top of the device.

Rotatable member 30 and arms 32, 33 are hollow tubular members and together form a conduit for conveying water under pressure through tubular member 30, through openings 35, 36 in member 30, and through respective arms 32, 33 to discharge orifices 34.

Means are also provided for securing the device to a faucet. A clamp member or the like may be provided for the purpose but it is preferred to employ a conventional type of elastomeric attachment member 40 as shown. These members are of a type well known and include an elastomeric tube 40 having an upper portion 41 which is a tight fit over an outlet of a water faucet. Various types of these elastomeric members are known and readily available and provide a water-tight connection to a conventional faucet. The lower portion of member 40 includes a cavity having a wall 42 which provides a water-tight seal with the upper portion of member 24 above top wall 21 of chamber 20. Suitable means (not shown) such as a clamp may be provided to secure wall 42 about member 24.

Attachment member 40 includes a central conduit 43 which, together with central conduit 28 in member 24 forms a conduit 50 for conveying water under pressure from a faucet to which the device is secureable to rotatable member 30.

A tube 60 is attached to bottom wall 22 to provide an outlet for removal of water from chamber 20 to permit rotation of arms 32 and 33 unobstructed by water in chamber 20. Tube 60 is preferably disposed radially outward of brush 70 such that water draining from chamber 20 does not fall onto brush 70. Other forms of water outlets can, of course, be provided. If desired, one or more outlets can be provided, and, of these, one or more may be provided to direct some or all of the water removed from chamber 20 onto brush 70.

A central hole is provided in bottom wall 22 to receive the upper end 71 of a brush member 70. The brush may be any conventional brush, preferably symmetrical about a vertical axis, such as the elongate brush shown which includes a plurality of bristles 72 secured to axial stem 73. A pin may be used to connect the upper end of brush stem 73 within a blind cavity formed in the lower end of rotatable member 30 for rotation therewith. However, it is preferred that the brush is readily removable. Accordingly, upper end 71 of brush 70 is preferably a friction fit in the blind cavity of member 30 and may be provided with one or more flat surfaces engageable with corresponding flat surfaces on the inner wall of the cavity to ensure positive rotation of the brush. The brush is thus easily removed for cleaning, replacement, and the like. Of course, several interchangeable brushes may be provided for various uses.

Figure 2:
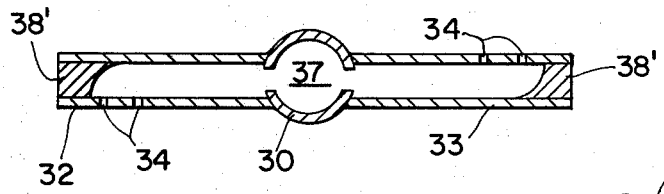

In use, the attachment member 40 is fitted over the outlet end of a water faucet with the device generally vertical and extending downwardly. The water under pressure flows through conduit 50 to central conduit 37 of member 30 and thence radially outwardly through openings 35, 36, into arms 32 and 33. A high velocity stream of water thus discharges generally horizontal and tangentially outward through orifices 34 in arms 32 and 33 thus imparting clockwise rotation of arms 32 and 33, member 30, and brush 70. Due to the design of the system, including relatively small holes 34 which may be, for example, from 0.5 to 10 mm in diameter, a small amount of water flow generates a great deal of power. It is preferred to weight arms 32, 33 to increase the momentum of the device. While this also increases inertia, the effect on the washing action of the device is pronounced: the brush rotation will remain high even when a dish or the like is pressed against the brush bristles with considerable pressure. Preferably, the arms are weighted by providing weights at the end of the arms. This is conveniently done by providing heavy and corrosion resistant metal caps or inserts at the outer ends of arms 32, 33. As shown in FIG. 2, the metal inserts 38' are arcuately shaped in plan view to direct the flow of water into the direction in which the stream of water emanates from orifices 34. To use the device, a dish or other item to be washed is held in contact with the brush. The item to be washed is wet in any convenient manner such as by the water emanating from spout 60 and this water may also be used to rinse the washed item. Soap or detergent may be applied in any convenient way such as by immersing the item in a small vessel containing soapy water, or soap may be applied directly to the item. It is preferred to provide the brush with a sponge, conveniently in the form of a sponge sleeve 74 which is readily fitted over the bristles as shown. The sponge has a soap-retaining characteristic which facilitates use of the device. After use, the device is simply removed from the faucet. As mentioned, the device may include a clamp or other means for securing the device to a faucet. A clamp of this type is preferably one which will permit the device to be moved out of the way for normal use of the faucet. It is preferred, however, to attach the device to the faucet temporarily and, for this purpose, the elastomeric attachment member shown is preferred.

Figure 3:
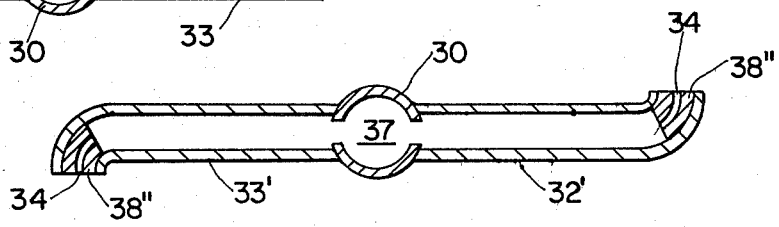

The orifices or openings in arms 32, 33 are preferably located adjacent the outer ends of the arm and preferably radially outward of the outer ends of bristles 72. Two openings are preferably provided. The orifices are preferably constructed and arranged to discharge each stream of water in a direction substantially tangential to the path of rotation of a respective orifice. The stream of water is, moreover, preferably directed downwardly at an acute angle with respect to the horizontal, to impart a slight lift to the tubular member and brush to facilitate rotation thereof. The outer ends of the arms may be curved, rearwardly, in plan view and orifices provided in heavy metal inserts 38" provided at the ends of the arms 32' 33' as shown in FIG. 3.

What is claimed is:

1. A rotating brush device comprising: a chamber, round in horizontal cross-section, and having a top wall, a bottom wall, and a peripheral side wall joining top and bottom walls; a bearing member attached to said top wall, said bearing member having a bearing surface; a rotatable tubular member having a flange, said flange resting on said bearing surface so that said rotatable tubular member is mounted for rotation in said chamber; at least two tubular arms mounted on said rotatable tubular member for rotation therewith and extending radially outward therefrom for rotation in a substantially horizontal plane in said chamber, said arms each including at least one opening in the walls for discharge of a high velocity stream of water out of a respective tubular arm in a direction to impart rotation of said arms and said rotatable member; a weighted baffle located at the outer ends of said tubular arms for defining a flow path directing water into a stream flowing in the direction of the water stream discharged from said orifices and also for increasing the rotational inertia and momentum of said arms; said rotatable tubular member forming with each of said tubular arms a conduit for conveying water under pressure through said rotatable tubular member and each of said tubular arms for discharge through said openings in said arms; means for securing said brush device to a water faucet; conduit means for conveying water under pressure from a faucet to which the device is secureable to said rotatable tubular member; water outlet means for removing water from said chamber to permit unobstructed rotation of said horizontal arms in said chamber; a rotatable brush mounted on the device for rotation below the bottom wall of said chamber and extending downwardly therefrom; and means connecting said rotatable brush means and said rotatable tubular member such that rotation of said rotatable brush member caused by rotation of said tubular arms caused by the flow of a high velocity stream of water through said arm openings effects rotation of said brush.

2. A device according to claim 1 wherein the openings have a diameter of from 0.5 to 10 mm.

3. A device according to claim 1 wherein each arm includes two of said openings.

4. A device according to claim 1 wherein said brush includes a vertical member coaxial with said rotatable tubular member, and bristles extending radially outward therefrom and wherein said openings are positioned radially outward a distance greater than the distance to which said bristles extend.

5. A device according to claim 1 wherein said orifice means are constructed and arranged to discharge said high velocity stream of water in a direction substantially tangential to the path of rotation of each respective orifice and at an acute angle downwardly with respect to horizontal to impart a slight lift to the rotatable tubular member and brush to facilitate rotation thereof.

6. A device according to claim 1 wherein said water outlet means comprises a conduit for conveying water from said chamber downwardly and out of contact with said brush.

7. A brush according to claim 1 wherein said flow path defining means comprises a curved baffle positioned in said tubular arm adjacent one of said openings.

8. A device according to claim 1 wherein said brush comprises a sponge member.

9. A device according to claim 8 wherein said sponge member comprises a sleeve surrounding a portion of said bristles.

10. A device according to claim 1 wherein said water faucet securing means comprises a tubular elastomeric member adapted to fit over the outlet of the faucet.

11. A device according to claim 10 wherein said water conveying conduit means comprises said tubular elastomeric member.

* * * * *